United States Patent [19]

Fry

[11] Patent Number: 4,908,486

[45] Date of Patent: Mar. 13, 1990

[54] RESONANT CAVITY OF A MICROWAVE DRIER

[75] Inventor: Allan R. Fry, The Channon via Lismore, Australia

[73] Assignee: Nearctic Research Centre, Australia

[21] Appl. No.: 180,986

[22] PCT Filed: Jun. 4, 1987

[86] PCT No.: PCT/AU87/00167

§ 371 Date: Feb. 10, 1988

§ 102(e) Date: Feb. 10, 1988

[87] PCT Pub. No.: WO87/07812

PCT Pub. Date: Dec. 17, 1987

[30] Foreign Application Priority Data

Jun. 5, 1986 [AU] Australia ..... PH06305

[51] Int. Cl.[4] ..... H05B 6/72

[52] U.S. Cl. ..... 219/10.55 A; 219/10.55 F; 34/1

[58] Field of Search ..... 219/10.55 A, 10.55 R, 219/10.55 F, 10.55 E; 333/227, 230; 34/1

[56] References Cited

U.S. PATENT DOCUMENTS

| | | | |
|---|---|---|---|
| 3,402,277 | 9/1968 | Muller | 219/10.55 F |
| 3,560,695 | 2/1971 | Williams et al. | 219/10.55 A |
| 3,851,131 | 11/1974 | Johnston et al. | 219/10.55 A |
| 3,855,440 | 12/1974 | Staats et al. | 219/10.55 F |
| 3,916,137 | 10/1975 | Jurgensen | 219/10.55 A |
| 3,975,606 | 8/1976 | Tanaka et al. | 219/10.55 F |
| 4,323,745 | 4/1982 | Berggren | 219/10.55 A |
| 4,361,744 | 11/1982 | Mercier et al. | 219/10.55 F |
| 4,631,380 | 12/1986 | Tran | 219/10.55 A |

*Primary Examiner*—Philip H. Leung
*Attorney, Agent, or Firm*—Darby & Darby

[57] ABSTRACT

A microwave cavity (1) for drying/heating having at least one microwave source (6) emitting microwave energy of wavelength W into the cavity (b 1). By design of the size, shape and dimensions of the cavity (1) and the placement of the microwave source/s (6), the number of resonance modes is maximized in a processing zone (8) in the cavity (1), and the number of resonance modes and reflected energy is minimum at the microwave source/s (6).

9 Claims, 2 Drawing Sheets

RESONANT CAVITY OF A MICROWAVE DRIER

The present invention relates to a microwave drier used for the processing of various materials for example crops after harvesting, such as grains, beans, fruit, rice and the like. The present invention is also useful for the processing of minerals and by-products of the mining industry, peat moss, molasses and sugar by products, cotton, wool, tea, sand, sewerage and any other products which require partial or complete moisture reduction. The present invention can also be used for sterilisation and the eradication of insect pests within a material to be treated. In particular, the present invention relates to the design of a resonant cavity of a microwave drier which can utilise, simultaneously two or more continuous microwave sources to effect the drying/heating of a load placed within said cavity without causing any adverse effects to either microwave source.

In previous attempts to dry/heat material by the use of microwave energy directed into a resonant cavity, problems of 'spot' drying arose, this was because the penetration of the microwaves into the material was not consistent throughout the material, thus leaving alternating hot and cold 'spots'. This effect was caused by destructive and constructive interference and the antinodes and nodes of the resonance within the cavity. In addition these prior art microwave driers utilised pulsed microwave sources beamed into a square or rectangular resonant cavity. The maximum number of modes throughout the cavity was dependent on the overall size of that cavity. The provision of rotating turntables or field/mode stirrers improved uniformity of heating within the cavity by moving the material to be processed through the cavity or continually altering the mode pattern within the cavity.

The use of stirrers within a cavity causes problems when simultaneous use of several continuous microwave sources is desired in order to increase energy density within the cavity. Stirrers disturb the modal pattern such that a stationary nodal/antinodal pattern is not established within the cavity, resulting in the tendency for the magnetron to cross couple with likely destructive results. The use of a small cavity to increase energy density causes a reduction in the number of available modes resulting in uneven heating.

One of the basic problems of the rectangular or square-shaped cavity is that the nodes or hot spots in the mode pattern within the cavity are evenly spaced throughout the cavity producing regularly spaced hot spots. Most items to be processed within a rectangular cavity do not fully fill the cavity and hence cannot make full use of all the nodes within the cavity, resulting in uneven heating of the item.

The present invention seeks to substantially alleviate the above problems by providing a microwave drying system which utilises one or more controlled continuous microwave sources to allow more uniform penetration of the load material stationary within or passing through a processing zone within the cavity. In particular, the present invention seeks to provide a resonant cavity which, by its particular choice of design shape, size and dimensions, and placement of at least one microwave source provides a more efficient method of microwave drying/heating and provides a greater number of modes within the useable processing zone.

CHAMBER DESIGN CRITERIA

The geometric shape of a cavity is preferably such as to create as many modes of resonance as possible within the processing zone and across the frequency band utilised. Additionally, if more than one microwave source is to be utilised then preferable conditions for continuous and simultaneous operation of several microwave sources should be maintained.

The preferable conditions for continuous and simultaneous operation of several microwave sources within the one resonant cavity include:

(a) A resonant cavity shape designed so that waves emitted from any microwave source, are not reflected to the same or any other microwave source except after many multiple reflections from the walls of the chamber with (i) consequential passage through the load material placed within or travelling through the cavity, and (ii) cross coupling to the resonant modes of the cavity.

This may be achieved by placing said sources along surface which does not directly face any other surface of the cavity, i.e., a perpendicular drawn from any point on such a surface does not intersect any other surface of the cavity at right angles. Achieving this geometry results in a condition where no mode can exist between these surfaces and therefore modal energy reflected back to a source mounted on such a surface is minimized with respect to these surfaces. Further, the number of direct reflections back to each source or any other source can be substantially minimized by careful choice of dimensions and the use of plane wave reflection geometry, as will be clear to those skilled in the art.

(b) The spacing of the microwave sources along one side plate of the cavity allows each microwave source to be positioned at an antinode of a major resonance and supported between the two parallel ends of the cavity said end plates being perpendicular to said side plates.

The chamber material preferably has high reflectivity with respect to the wave length of the microwave radiation to be utilised, and is non magnetic.

In one broad form, the present invention provides a microwave cavity having at least one microwave energy source emitting microwave energy of wavelength W into said cavity, at least two parallel and opposing inner surfaces separated by a distance proportional to the wavelength W, such that in operation, cross-coupling of microwave energy occurs with substantial maximizing of the number of resonance modes between said inner surfaces within the processing zone, and, with substantial minimizing of resonant mode energy and reflected energy at said microwave source/s.

A preferred emodiment of the present invention will be more fully described with reference to the accompanying drawings, in which.

Figure 1:
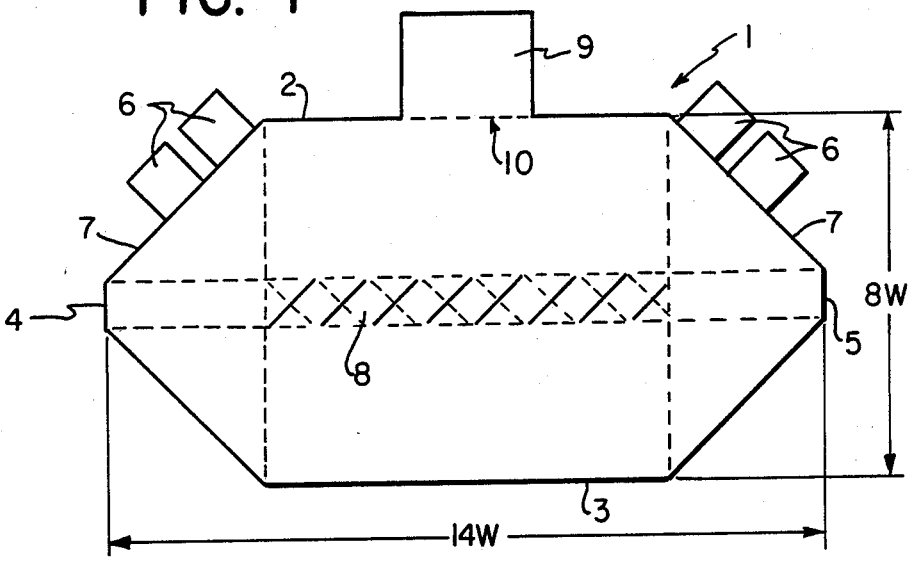
FIG. 1 is a cross-sectional view of a resonant cavity in accordance with a first embodiment of the present invention.
Figure 2:
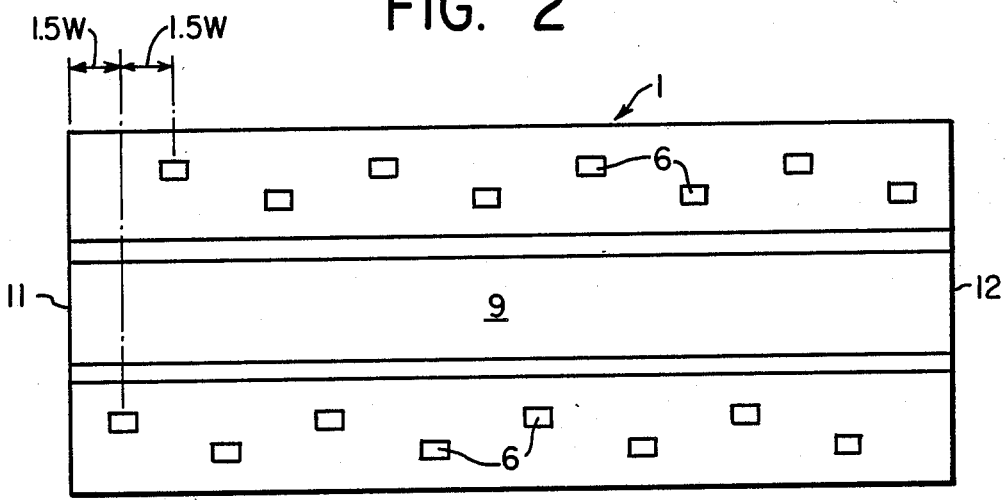
FIG. 2 shows a plan view of the drying cavity, of FIG. 1 showing dimensions in terms of wavelength of the microwave energy used.

In FIG. 1 is shown a cross-sectional view of a first embodiment of the present invention. The cavity, generally designated by the numeral 1 comprises ten inner surfaces. The upper and lower surfaces 2 and 3 respectively, are provided in parallel facing relationship, as are the side surfaces 4 and 5. A plurality of microwave sources 6 are spaced along the length of the cavity, as shown in FIG. 2. Each of the microwave sources 6 are mounted on the sloping upper side plates 7, such that microwave energy is beamed into the chamber 1 through waveguides (not shown). The shape and placement of each of the inner surfaces of the cavity 1, together with the placement of each of the microwave sources 6, is such that no direct reflections into each microwave source is possible, either from the same or other microwave sources.

At the intersection between each of the pairs of parallel inner surfaces 2 and 3, and, 4 and 5, and end plates 11 and 12 respectively, is defined a processing zone 8, in which the material to be dried/heated is placed. The material may be placed in the processing zone 8, or may be moved through on a conveyor system (not shown). At the top of the cavity 1, is shown a ducting means 9, which allows the extraction of moist air from the cavity 1, through a perforated section 10. The perforated section 10 allows the passage of moist air from the cavity, whilst reflecting the microwaves within the cavity.

In FIG. 2 each of the microwave sources 6 are placed alternatively on each side of the chamber, along the length of the chamber 1. A conveyor system (not shown) enters through end 11, passes through the centre of chamber 1 and exits through end 12; suitable chokes (microwave attenuators) being used at the entry and exit points of the conveyor system. The conveyor system preferably consists of a porous conveyor belt for use with granular products, such that air may pass directly through the product. The conveyor belt is preferably sloped from one end of the cavity to the other, or is angled through the centre of the cavity 1, to further enhance uniformity of the exposure of the material on the conveyor belt to microwave energy.

In use, microwave energy is beamed into the cavity 1 from each of the microwave sources 6. The microwave energy undergoes multiple reflections off the inner surfaces of the cavity 1, after which most of the energy becomes cross coupled to one of the many resonant modes of the cavity 1, existing between the sets of parallel sides 4 and 5, and 2 and 3, respectively. The intersection between each of these sides and the end plates defines the processing zone 8. Since the distance between each parallel set of sides is geater than the corresponding dimension of the processing zone 8, a greater number of modes can exist than in a rectangular cavity having the dimensions of this processing zone 8. This greater number of modes within the processing zone 8 results in better uniformity of drying/heating. The placement of each of the inner surfaces of the cavity 1 is carefully selected such that, the number of modes of resonance is maximized within said processing zone, and such that the number of modes of resonance is minimized at the placement of the microwave sources 6.

Figure 3:
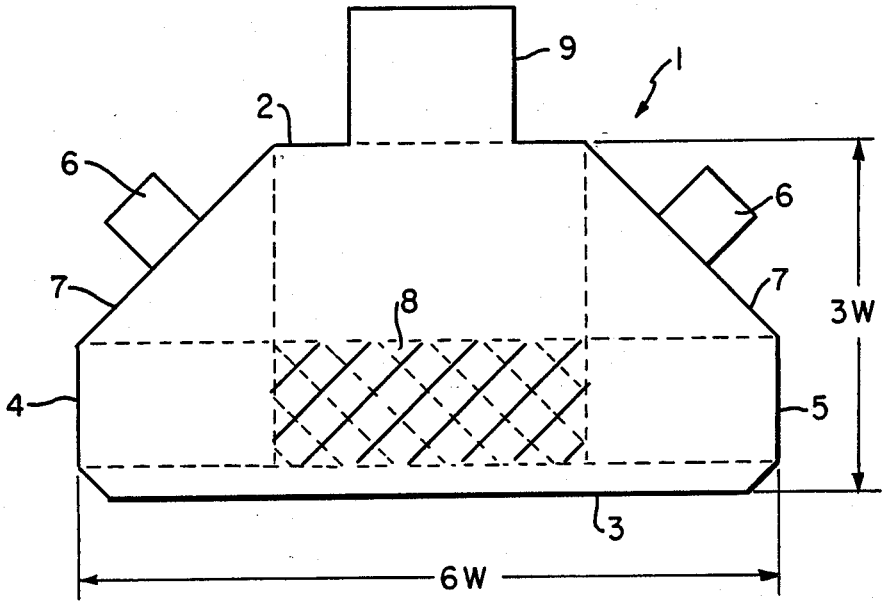
FIG. 3 is a cross-sectional view of the resonant cavity of a second preferred embodiment of the invention; and, FIG. 4 shows a plan view of the drying cavity of FIG. 3 showing dimensions in terms of the wavelength of the microwave energy used.

In FIG. 3 is shown a cross-section of a second embodiment of a microwave chamber in accordance with the present invention. The chamber 1 is again provided with three sets of parallel sides 2 and 3, and 4 and 5, and end plates 11 and 12 respectively. This embodiment shows a smaller sized chamber, in which the placement of the microwave sources 6 and the spacing of the inner surfaces becomes more critical to achieve a processing zone 8 of higher energy density.

Figure 4:
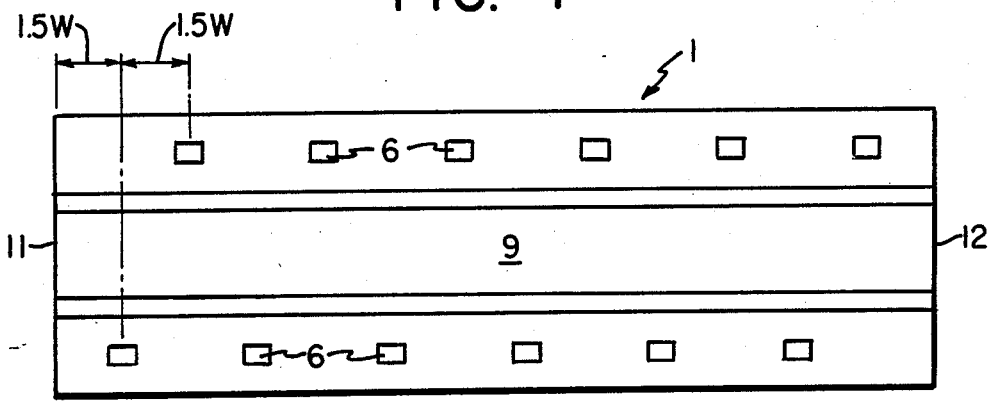

In FIG. 4 is shown a plan view of the embodiment of FIG. 3, wherein the cavity 1 is provided with eight microwave sources 7 placed alternatively on opposite sides of the cavity, along the length of the cavity, four spare mountings being used as viewing ports covered with perforated sheets.

It should be understood that numerous variations and modifications may be made to the cavity of the present invention for example in size, shape or in placement of microwave sources without departing from the overall spirit and scope of the invention as herein described.

I claim:

1. A microwave drier, comprising:

a cavity; and at least one microwave energy source for emitting microwave energy into said cavity, said cavity having at least two parallel and opposing inner surfaces separated from each other by a predetermined distance so that, in operation, cross-coupling of said microwave energy occurs within said cavity to produce a processing zone in said cavity which is smaller in size than said cavity and to produce reflected and resonant mode energy within said cavity, said processing zone having a greater concentration of resonance modes than is present anywhere else in said cavity, said microwave energy source being arranged so that said reflected and resonant mode energy is minimum at said microwave energy source with respect to any area within said cavity.

2. A microwave drier as claimed in claim 1, wherein two microwave energy sources emit microwave energy of wavelength W into said cavity.

3. A microwave drier as claimed in claim 1, wherein said at least one microwave energy source is continuously operated.

4. A microwave drier as claimed in claim 3 wherein the dimensions of said inner surfaces are proportional to the wavelength W to maximize the number of modes.

5. A microwave drier as claimed in claim 4 wherein said cavity has more than four inner surfaces.

6. A microwave drier as claimed in claim 5 wherein said cavity has ten inner surfaces defining an irregular decahedron of irregular octahedral cross-section.

7. A microwave drier as claimed in claim 6 further comprising a plurality of microwave energy sources are placed at multiples of ½ W along said cavity.

8. A microwave drier, comprising:

a cavity; and at least one microwave energy source for emitting microwave energy into said cavity, said cavity having at least two parallel and opposing inner surfaces separated from each other by a predetermined distance so that, in operation, cross-coupling of said microwave energy occurs within said cavity to produce a processing zone in said cavity which is smaller in size than said cavity and to produce reflected and resonant mode energy within said cavity, said processing zone having a greater concentration of resonance modes than is present anywhere else in said cavity, said microwave energy source being arranged at an antinode of major resonance occurring between said inner surfaces so that said reflected and resonant mode energy is minimum at said microwave energy source with respect to any area within said cavity.

9. A microwave drier as claimed in claim 8, further comprising:

a plurality of microwave energy sources arranged respectively at antinodes of major resonance occurring between said inner surfaces.

* * * * *